US005114377A

United States Patent [19]

Cove Mercuri et al.

[11] Patent Number: 5,114,377

[45] Date of Patent: May 19, 1992

[54] FLEXIBLE TOY AND THERAPEUTIC DEVICE

[76] Inventors: Leslie M. Cove Mercuri; Luis A. Mercuri, both of 71 Waller Ave., White Plains, N.Y. 10605

[21] Appl. No.: 503,059

[22] Filed: Apr. 2, 1990

[51] Int. Cl.[5] ..... A63H 33/00; A44C 5/00

[52] U.S. Cl. ..... 446/487; 446/26; 63/3; 428/542.2; 428/12; 482/44

[58] Field of Search ..... 446/487, 486, 26, 71; 272/67, 68; 273/155; 63/3, 4, 5.1, 10, 11; 428/9, 12, 542.2

[56] References Cited

U.S. PATENT DOCUMENTS 724,226 3/1903 Wittmann ..... 446/487

3,916,559 11/1975 Floweraday ..... 446/487

4,219,958 9/1980 Shulyak ..... 446/487

*Primary Examiner*—Mickey Yu

[57] ABSTRACT

A framework assembly that can be selectively manipulated to a variety of configurations for leisure activity, hand and finger exercise and as a teaching aid for shape recognition. Respective circular frame members have a plurality of semi-circled frame members rotatably attached at their ends to the circular frame members in successively overlapping engagement along the lengths of the circular frame members. Two of the semi-circled frame members are rotatably attached to each other thereby providing a framework assembly that can be configured in virtually an infinite variety of shapes.

6 Claims, 4 Drawing Sheets

FLEXIBLE TOY AND THERAPEUTIC DEVICE

BACKGROUND OF THE INVENTION

The present invention generally relates to toys and novelty articles of manufacture. More specifically, this invention relates to a flexible framework assembly having psychological and physical therapeutic utility.

SUMMARY OF THE INVENTION

An object of the present invention is to provide an article of manufacture for leisure activity.

Another object of the present invention is to provide a hand and finger exercising tool.

It is also an object of this invention to provide a novel article of manufacture having psychological therapeutic utility.

A further object of this invention is to provide a flexible device adaptable to various configurations for support of items of varying size and for use as a teaching aid for shape recognition.

Another object of the present invention is to provide an article of manufacture useful as an arm or wrist bracelet adaptable to various configurations.

A still further object of this invention is to provide a flexible mobile.

These and other objects and advantages of the present invention will be apparent to those skilled in the art from the following description of a preferred embodiment, claims and appended drawings wherein there is disclosed a framework assembly comprising first and second circular frame members having respective pluralities of semi-circled frame members rotatably attached at their ends in overlapping engagement along the length of the respective circular frame members and rotatably attached to each other at the midpoints of the semi-circled frame members, the framework assembly further including additional paired semi-circled frame members rotatably attached at their ends in overlapping engagement along the length of the respective circular frame members, thereby forming a flexible toy and therapeutic device selectively adaptable to a variety of configurations.

DESCRIPTION OF PREFERRED EMBODIMENTS

Figure 1:
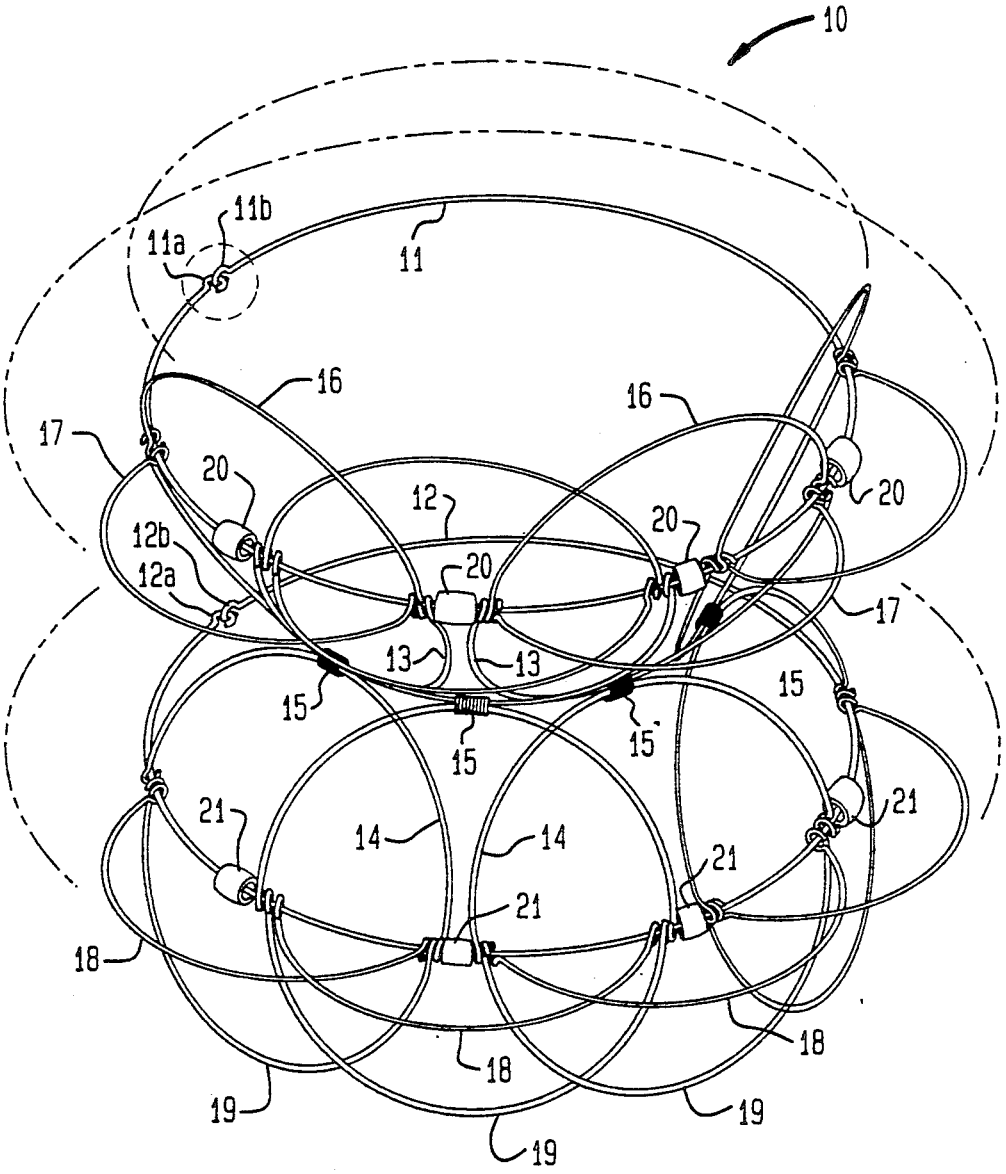
FIG. 1 is a perspective view of the framework assembly of the present invention.

FIG. 1 illustrates in a perspective view the framework assembly 10 of the present invention. The framework assembly 10 is preferably formed from a plurality of interconnected metallic wire frame members generally comprising a first circular frame member 11, a second circular frame member 12, a plurality of first semi-circled frame members 13, a plurality of second semi-circled frame members 14, means 15 to attach said first semi-circled frame members 13 and said second semi-circled frame members 14, a plurality of third semi-circled frame members 16, a plurality of fourth semi-circled frame members 17, a plurality of fifth semi-circled frame members 18, and a plurality of sixth semi-circled frame members 19. A plurality of first beads 20 are disposed along the length of said first circular frame member 11 and a plurality of second beads 21 are disposed along the length of said second circular frame member 12.

Figure 2:
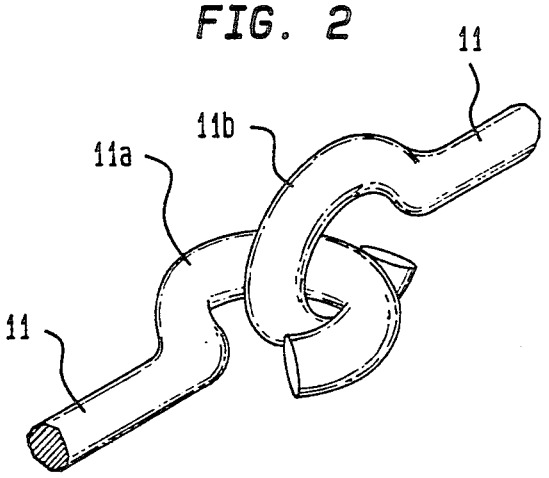
FIG. 2 is an enlarged perspective view of the encircled portion of FIG. 1.

The first circular frame member 11 and said second circular frame member 12 are respectively formed by a length of wire shaped into a circle having loops 11*a*, 11*b* and 12*a*, 12*b* formed at the respective ends of each length of wire 11, 12. As can be best seen in the enlarged perspective view of the encircled portion of FIG. 1 illustrated in FIG. 2 the loops 11*a*, 11*b* at the respective ends of the length of wire 11 are interconnected at perpendicular dispositions to form a closed circle. The plurality of first semi-circled frame members 13 are rotatably attached at their ends to said first circular frame member 11 in successively overlapping engagement along the length of said first circular frame member 11, i.e. adjacently disposed semi-circled frame members 13 overlap the preceding semi-circled frame member 13. The respective ends 13*a*, 13*b* of each first semi-circled frame member 13 are looped and thereby engage the first circular frame member 11 in rotatable attachment. Likewise, the plurality of second semi-circled frame members 14 are rotatably attached at their ends to said second circular frame member 12 in successively overlapping engagement along the length of said second circular frame member 12. The respective ends 14*a*, 14*b* of each second semi-circled frame member 14 are looped and thereby engage the second circular frame member 12 in rotatable attachment. A plurality of first beads 20 are respectively attached to the first circular frame member 11 in rotatable engagement between adjacently disposed first semi-circled frame members 13, and a plurality of second beads 21 are respectively attached to the second circular frame member 12 in rotatable engagement between adjacently disposed second semi-circled frame members 14.

Respective first semi-circled frame members 13 and second semi-circled frame members 14 are disposed in vertical alignment and the respectively aligned first semi-circled frame members 13 and second semi-circled frame members 14 are rotatably attached at the respective midpoints of said semi-circled frame members 13, 14 by attachment means 15 preferably comprising a length of wire wound about said first semi-circled frame members 13 and said second semi-circled frame members 14.

The plurality of third semi-circled frame members 16 and said plurality of fourth semi-circled frame members 17 are respectively and rotatably attached at their ends to said first circular frame member 11 in successively overlapping engagement along the length of said first circular frame member 11, i.e. adjacently disposed third semi-circled frame members 16 overlap the preceding third semi-circle frame member 16 and adjacently disposed fourth semi-circled frame members 17 overlap the preceding fourth semi-circled frame member 17. The respective ends 16*a*, 16*b* of each third semi-circled frame member 16 and the respective ends 17*a*, 17*b* of each fourth semi-circled frame member 17 are looped and thereby engage the first circular frame member 11 in rotatable attachment. The ends of said third semi-circled frame members 16 are adjacently disposed to the inside of the ends of the corresponding first semi-circled frame member 11. The ends of said fourth semi-circled frame members 17 are adjacently disposed to the inside of the ends of the corresponding third semi-circled frame member 16.

The plurality of fifth semi-circled frame members 18 and said plurality of sixth semi-circled frame members 19 are respectively and rotatably attached at their ends to said second circular frame member 12 in successively overlapping engagement along the length of said second circular frame member 12, i.e. adjacently disposed fifth semi-circled frame members 18 overlap the preceding fifth semi-circled frame member 18 and adjacently disposed sixth semi-circled frame members 19 overlap the preceding sixth semi-circled frame member 19. The respective ends 18*a*, 18*b* of each fifth semi-circled frame member 18 and the respective ends 19*a*, 19*b* of each sixth semi-circled frame member 19 are looped and thereby engage the second circular frame member 12 in rotatable attachment. The ends of said fifth semi-circled frame members 18 are adjacently disposed to the inside of the ends of the corresponding second semi-circled frame member 14. The ends of said sixth semi-circled frame members 19 are adjacently disposed to the inside of the ends of the corresponding fifth semi-circled frame member 18. The framework assembly 10 as heretofore described provides a device that can be manipulated to form a variety of configurations by rotation of the various semi-circled frame members 13, 14, 16, 17, 18, 19 about the respective first circular frame member 11 and second circular frame member 12, and by relative rotation of the first semi-circled frame members 13 and the second semi-circled frame members 14 about the attachment means 15. While the third semi-circled frame members 16, the fourth semi-circled frame members 17, the fifth semi-circled frame members 18, and the sixth semi-circled frame members 19 can be rotated substantially 360° about the first circular frame member 11 and the second circular frame member 12, respectively, the relative rotation of the first semi-circled frame members 13 and the second semi-circled frame members 14 is restricted to approximately 270°. The framework assembly 10 can be flatten to bring the first circular frame member 11 and the second circular frame member 12 in adjacent disposition by rotating the attached midpoints of the respective first semi-circled frame members 13 and the second semi-circled frame members 14 outwardly, but the crossing of the first semi-circled frame members 13 and the second semi-circled frame members 14 when these members are rotated inwardly limits the inward rotation to form a waist that cannot be further contracted without breaking the framework assembly 10 apart.

Figure 3:
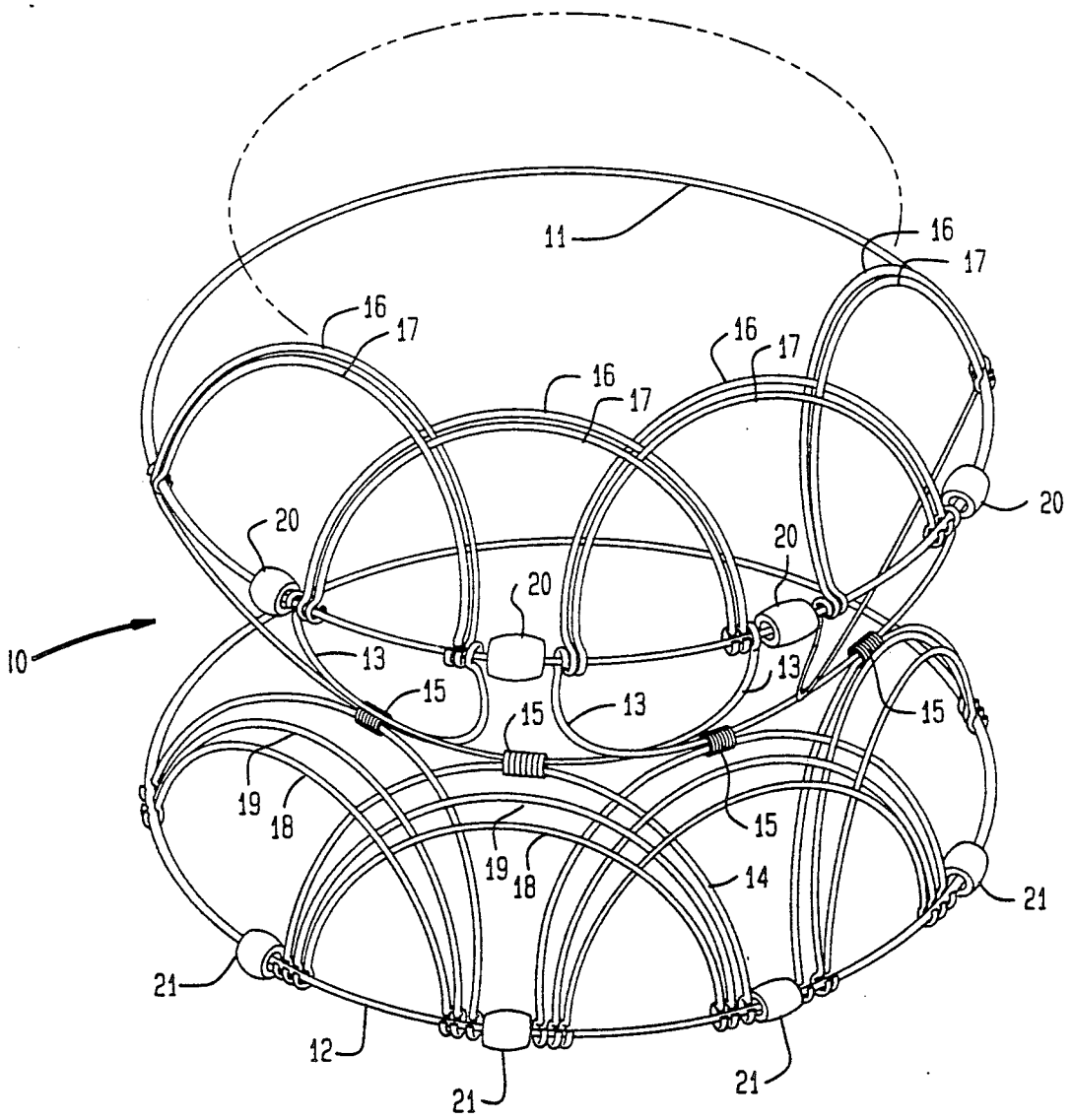
FIG. 3 is a perspective view of the framework assembly of the present invention utilized as a candle holder.

FIG. 3 illustrates a configuration of the framework assembly 10 of the present invention useful as a candle holder. The framework assembly 10 is disposed having the fifth semi-circled frame members 18 and the sixth semi-circled frame members 19 rotated adjacent to the second semi-circled frame members 14 thereby permitting the second circular frame member 12 to rest on the supporting surface. The first semi-circled frame members 13 and the second semi-circled frame members 14 are rotated inwardly to form the aforementioned waist. A candle 30 is shown in FIG. 3 seated upon the rotated fifth and sixth semi-circled frame members 18, 19. The waist engages the lower portion of the candle 30 and the third and fourth semi-circled frame members 16, 17 engage the upper portion of the candle 30. Said waist and said third and fourth semi-circled frame members 16, 17 can be selectively adjusted to engage candles of varying size.

Figure 4:
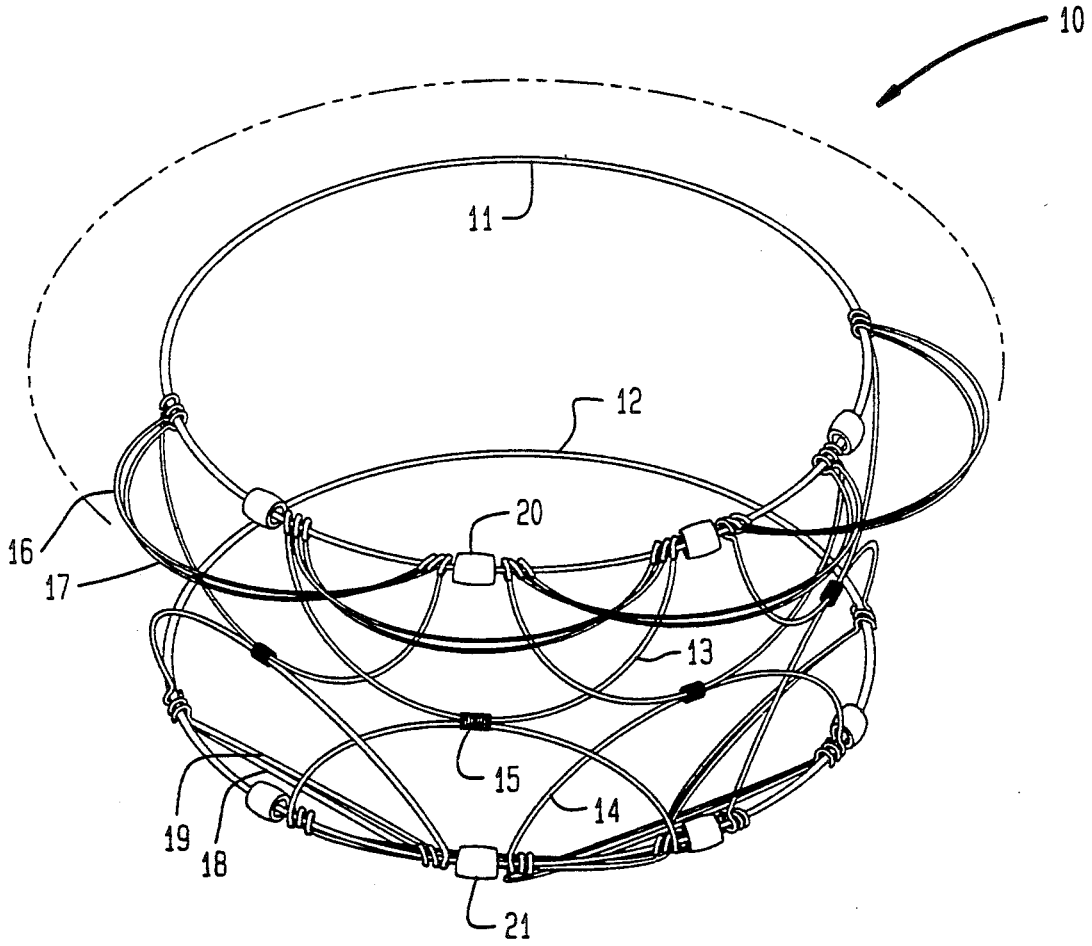
FIG. 4 is a perspective view of the framework assembly of the present invention utilized as a soap dish.

FIG. 4 illustrates a configuration of the framework assembly 10 of the present invention useful as a soap dish. The fifth and sixth semi-circled frame members 18, 19 are disposed in a concavely-curved shape to form a bowl for receipt of one or a plurality of soap bars 40. The fifth and sixth semi-circled frame members 18, 19 support the framework assembly 10 on the sink or bathtub, for examples, upon which the framework assembly 10 is disposed The first and second circular frame members 11, 12 are adjacently disposed having the first and second semi-circled frame members 13, 14 extending outwardly from said bowl. The third and fourth semi-circled frame members 16, 17 are disposed adjacent to the outwardly extending first and second semi-circled frame members 13, 14. A particular advantage of a soap dish formed as described is that water clinging to the soap bars 40 can drain away from said dish thereby preventing the dissolving of the soap bars 40 disposed therein.

Figure 5:
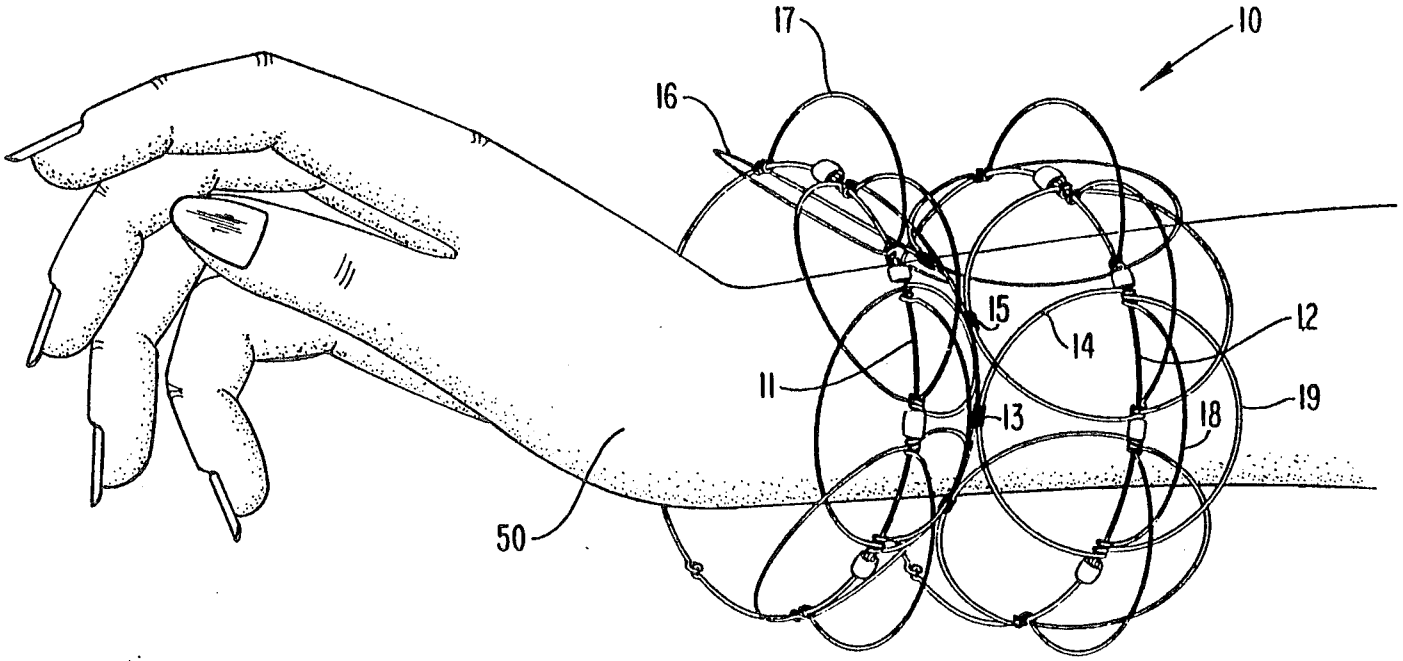
FIG. 5 is a perspective view of the framework assembly of the present invention utilized as a wrist bracelet.

FIG. 5 illustrates a configuration of the framework assembly 10 of the present invention useful as a wrist bracelet. In this configuration the first and second semi-circled frame members 13, 14 are vertically aligned to form a cylinder having the first circular frame member 11 disposed at one end of the cylinder and the second circular frame member 12 disposed at the opposite end of the cylinder. The third, fourth, fifth and sixth semi-circled frame members 16, 17, 18, 19 are rotated adjacent to said first and second semi-circled frame members 13, 14 thereby permitting the framework assembly 10 to be disposed about the wrist 50 of a person as a piece of jewelry.

The various configurations of framework assembly 10 heretofore described are illustrative of the multiple manipulations of the assembly 10 due to the interconnected independently rotatable frame members. The framework assembly 10 of the present invention is also useful as a therapeutic device and as a teaching aid for shape recognition. Manipulation of the framework assembly 10 has a calming effect on the manipulator which is useful in relieving tension and nervous energy. Furthermore, the assembly 10 can be used as a hand and finger exercising tool for persons suffering from arthritis or similar disabling conditions. To facilitate shape recognition the framework assembly 10 can be used as a teaching aid whereby a teacher may form a configuration and have the students attempt to mimic this configuration.

As can be understood from the foregoing the framework assembly 10 has varied utility and provides a device that can be manipulated into numerous configurations. Various changes, modifications and additions to the invention as disclosed may be made without departing from the spirit and scope of the invention as held in the appended claims. For example, while the framework assembly 10 has been described having a plurality of semi-circled frame members it should be understood that the assembly may be formed utilizing triangular or like frame members The framework assembly 10 can be formed in a variety of sizes making it useful as playground equipment and the like.

Therefore in view of the foregoing we claim:

1. A framework assembly forming a flexible toy and therapeutic device adaptable to a variety of selective configurations comprising a first circular frame member;

a second circular frame member;

a plurality of first semi-circled frame members rotatably attached at their ends to said first circular frame member in successively overlapping engagement along the length of said first circular frame member;

a plurality of second semi-circled frame members rotatably attached at their ends to said second circular frame member in successively overlapping engagement along the length of said second circular frame member;

a plurality of first beads rotatably attached to said first circular frame member between adjacently disposed first semi-circled frame members;

a plurality of second beads rotatably attached to said second circular frame member between adjacently disposed second semi-circled frame members;

means to attach the midpoints of said first semi-circled frame member and said second semi-circled frame member in rotatable engagement;

a plurality of third semi-circled frame members corresponding in number to said plurality of first of semi-circled frame members, said plurality of third semi-circled frame members being rotatably attached at their ends to said first circular frame member in successively overlapping engagement along the length of said first circular frame member, the ends of said plurality of third semi-circled frame members being adjacently disposed to the inside of the ends of the corresponding first semi-circled frame member;

a plurality of fourth semi-circled frame members corresponding in number to said plurality of third semi-circled frame members, said plurality of fourth semi-circled frame members being rotatably attached to said first circular frame member and disposed at a side of the corresponding plurality of third semi-circled frame member in successively overlapping engagement along the length of said first circular frame member, the ends of said plurality of fourth semi-circled frame members being adjacently disposed to the inside of the ends of the corresponding third semi-circled frame member;

a plurality of fifth semi-circled frame members corresponding in number to said plurality of second semi-circled frame members, said plurality of fifth semi-circled frame members being rotatably attached at their ends to said second circular frame member in successively overlapping engagement along the length of said second circular frame member, the ends of said plurality of fifth semi-circled frame members being adjacently disposed to the inside of the ends of the corresponding second semi-circled frame member; and a plurality of sixth semi-circled frame members corresponding in number to said plurality of fifth semi-circled frame members, said plurality of sixth semi-circled frame members being rotatably attached to said second circular frame member and at a side of the corresponding plurality of fifth semi-circled frame member in successive overlapping engagement along the length of said second circular frame member, the ends of said plurality of sixth semi-circled frame members being adjacently disposed to the inside of the ends of the corresponding fifth semi-circled frame member.

2. A framework assembly as described in claim 1 wherein said first circular frame member, said second circular frame member, said plurality of first semi-circled frame members, said plurality of second semi-circled frame members, said plurality of third semi-circled frame members, said plurality of fourth semi-circled frame members, said plurality of fifth semi-circled frame members, and said plurality of sixth semi-circled frame members are formed from metallic wire.

3. A framework assembly as described in claim 2 wherein said first beads and said second beads are formed from rigid plastic material.

4. A framework assembly as described in claim 3 wherein said means to attach the midpoints of said first semi-circled frame members and said second semi-circled frame members comprises a length of metallic wire wound about said first semi-circled frame members and said second semi-circled frame members.

5. A framework assembly forming a flexible toy and therapeutic device adaptable to a variety of selective configurations comprising a first circular frame member formed by a length of wire shaped into a circle having loops formed at the respective ends of said length of wire, said loops being interconnected to form a closed circle;

a second circular frame member formed by a length of wire shaped into a circle having loops formed at the respective ends of said length of wire, said loops being interconnected to form a closed circle;

a plurality of first semi-circled frame members formed from metallic wire rotatably attached at their ends to said first circular frame member in successively overlapping engagement along the length of said first circular frame member;

a plurality of second semi-circled frame members formed from metallic wire rotatably attached at their ends to said second circular frame member in successively overlapping engagement along the length of said second circular frame member;

a plurality of first beads formed from rigid plastic material rotatably attached to said first circular frame member between adjacently disposed first semi-circled frame members;

a plurality of second beads formed from rigid plastic material rotatably attached to said second circular frame member between adjacently disposed second semi-circled frame members;

means to attach the midpoints of said first semi-circled frame members and said second semi-circled frame members in rotatable engagement comprising a length of metallic wire wound about said first semi-circled frame members and said second semi-circled frame members;

a plurality of third semi-circled frame members formed from metallic wire corresponding in number to said plurality of first semi-circled frame members, said plurality of third semi-circled frame members being rotatably attached at their ends to said first circular frame member in successively overlapping engagement along the length of said first circular frame member, the ends of said plurality of third semi-circled frame members being adjacently disposed to the inside of the ends of the corresponding first semi-circled frame member;

a plurality of fourth semi-circled frame members formed from metallic wire corresponding in number to said plurality of third semi-circled frame members, said plurality of fourth semi-circled frame members being rotatably attached at their ends to said first circular frame member and disposed at a side of the corresponding third semi-circled frame member in successively overlapping engagement along the length of said first circular frame member, the ends of said plurality of fourth semi-circled frame members being adjacently disposed to the inside of the ends of the corresponding third semi-circled frame member;

a plurality of fifth semi-circled frame members formed from metallic wire corresponding in number to said plurality of second semi-circled frame members, said plurality of fifth semi-circled frame members being rotatably attached at their ends to said second circular frame member in successively overlapping engagement along the length of said second circular frame member, the ends of said plurality of fifth semi-circled frame members being adjacently disposed to the inside of the ends of the corresponding second semi-circled frame member; and a plurality of sixth semi-circled frame members formed from metallic wire corresponding in number to said plurality of fifth semi-circled frame members, said plurality of sixth semi-circled frame members being rotatably attached at their ends to said second circular frame member and at a side of the corresponding fifth semi-circled frame member in successively overlapping engagement along the length of said second circular frame member, the ends of said plurality of sixth semi-circled frame members being adjacently disposed to the inside of the ends of the corresponding fifth semi-circled frame member.

6. A method of exercising the fingers and hands of a person having arthritis or similar disabling condition which comprises selectively manipulating a framework assembly comprising a first circular frame member formed by a length of wire shaped into a circle having loops formed at the respective ends of said length of wire, said loops being interconnected to form a closed circle;

a second circular frame member formed by a length of wire shaped into a circle having loops formed at the respective ends of said length of wire, said loops being interconnected to form a closed circle;

a plurality of first semi-circled frame members formed from metallic wire rotatably attached at their ends to said first circular frame member in successively overlapping engagement along the length of said first circular frame member;

a plurality of second semi-circled frame members formed from metallic wire rotatably attached at their ends to said second circular frame member in successively overlapping engagement along the length of said second circular frame member;

a plurality of first beads formed from rigid plastic material rotatably attached to said first circular frame member between adjacently disposed first semi-circled frame members;

a plurality of second beads formed from rigid plastic material rotatably attached to said second circular frame member between adjacently disposed second semi-circled frame members;

means to attach the midpoints of said first semi-circled frame members and said second semi-circled frame members in rotatable engagement comprising a length of metallic wire wound about said first semi-circled frame members and said second semi-circled frame members;

a plurality of third semi-circled frame members formed from metallic wire corresponding in number to said plurality of first semi-circled frame members, said plurality of third semi-circled frame members being rotatably attached at their ends to said first circular frame member in successively overlapping engagement along the length of said first circular frame member, the ends of said plurality of third semi-circled frame members being adjacently disposed to the inside of the ends of the corresponding first semi-circled frame member;

a plurality of fourth semi-circled frame members formed from metallic wire corresponding in number to said plurality of third semi-circled frame members, said plurality of fourth semi-circled frame members being rotatably attached at their ends to said first circular frame member and disposed at a side of the corresponding third semi-circled frame member in successively overlapping engagement along the length of said first circular frame member, the ends of said plurality of fourth semi-circled frame members being adjacently disposed to the inside of the ends of the corresponding third semi-circled frame member;

a plurality of fifth semi-circled frame members formed from metallic wire corresponding in number to said plurality of second semi-circled frame members, said plurality of fifth semi-circled frame members being rotatably attached at their ends to said second circular frame member in successively overlapping engagement along the length of said second circular frame member, the ends of said plurality of fifth semi-circled frame members being adjacently disposed to the inside of the ends of the corresponding second semi-circled frame member; and a plurality of sixth semi-circled frame members formed from metallic wire corresponding in number to said plurality of fifth semi-circled frame members, said plurality of sixth semi-circled frame members being rotatably attached at their ends to said second circular frame member and at a side of the corresponding fifth semi-circled frame member in successively overlapping engagement along the length of said second circular frame member, the ends of said plurality of sixth semi-circled frame members being adjacently disposed to the inside of the ends of the corresponding fifth semi-circled frame member.

* * * * *